US009388531B2

(12) United States Patent
Gianni

(10) Patent No.: US 9,388,531 B2
(45) Date of Patent: Jul. 12, 2016

(54) PLANT FOR THE PRODUCTION OF EMBOSSED ARTICLES

(71) Applicant: G.E.D. s.a.s. di Gianni Paolo & C., Lucca (IT)

(72) Inventor: Paolo Gianni, Lucca (IT)

(73) Assignee: G.E.D. S.A.S. DI GIANNI PAOLO & C., Lucca (IT)

( * ) Notice: Subject to any disclaimer, the term of this patent is extended or adjusted under 35 U.S.C. 154(b) by 0 days.

(21) Appl. No.: 14/760,143

(22) PCT Filed: Jan. 9, 2014

(86) PCT No.: PCT/IB2014/058157
§ 371 (c)(1),
(2) Date: Jul. 9, 2015

(87) PCT Pub. No.: WO2014/108853
PCT Pub. Date: Jul. 17, 2014

(65) Prior Publication Data

US 2015/0354138 A1 Dec. 10, 2015

(30) Foreign Application Priority Data

Jan. 11, 2013 (IT) ..... FI2013A0010

(51) Int. Cl.
*D21F 9/04* (2006.01)
*B31F 1/07* (2006.01)

(52) U.S. Cl.
CPC ... *D21F 9/04* (2013.01); *B31F 1/07* (2013.01); *B31F 2201/0761* (2013.01); *B31F 2201/0779* (2013.01); *B31F 2201/0787* (2013.01); *B31F 2201/0792* (2013.01)

(58) Field of Classification Search
CPC ..... B31F 1/07; D21F 9/04
USPC ..... 162/357
See application file for complete search history.

(56) References Cited

U.S. PATENT DOCUMENTS

| | | | | |
|---|---|---|---|---|
| 3,741,851 | A * | 6/1973 | Erb et al. | B29C 59/046 156/209 |
| 7,384,505 | B2 | 6/2008 | Zoller et al. | |
| 2003/0048472 | A1* | 3/2003 | Perdu | G03G 15/5075 358/1.15 |
| 2010/0163194 | A1* | 7/2010 | Sauter | B31F 1/07 162/114 |
| 2010/0181040 | A1* | 7/2010 | Perini | B31F 1/07 162/362 |
| 2014/0371043 | A1* | 12/2014 | Perini | B31F 1/07 492/15 |

OTHER PUBLICATIONS

International Search Report and Written Opinion issued in PCT Application No. PCT/IB2014/058157 mailed Apr. 24, 2014 (9 pages).

* cited by examiner

*Primary Examiner* — Mark Halpern
(74) *Attorney, Agent, or Firm* — Lucas & Mercanti, LLP

(57) ABSTRACT

A plant for the production of embossed articles is disclosed. Upstream of the embossing group for the plant and add on a glue dispensing unit and/or a printing unit having a cliché roll for the application of the glue on a web of band or ink on the band is provided. The web or the band moves between the cliché roll and a contrast cylinder. Actuator means are provided for approaching or moving away a portion of the cliché roll from the contrast cylinder. Thus, regardless of the type of paper used, it is possible to obtain a perfect adhesion of the webs without jeopardizing the softness of the paper used. It is also possible to obtain the printing in selected areas of the product being processed.

14 Claims, 9 Drawing Sheets

PLANT FOR THE PRODUCTION OF EMBOSSED ARTICLES

CROSS-REFERENCE TO RELATED APPLICATIONS

This application is a 371 of PCT/IB2014/058157, filed Jan. 9, 2014, which claims the benefit of Italian Patent Application No. FI2013A000010, filed Jan. 11, 2013, the entire disclosure of each of which is incorporated herein by reference.

FIELD OF THE INVENTION

The invention generally refers to the field of plants and equipment for processing yieldable material such as paper, fabric, leather, plastic bands, paper sheets, films, and in particular for obtaining embossed designs or decorative patterns thereon through embossing processes, especially in the paper tissue industry for producing paper napkins, paper handkerchiefs, toilet papers, paper towels and similar products.

BACKGROUND OF THE INVENTION

A production line of the conventional type in the paper tissue industry for obtaining embossed products such as the aforementioned ones, is schematically illustrated in FIG. 1. A reel of a multiweb paper band, for example with three/four webs, indicated with B, is unrolled in an unwinding device 1. The unrolled band N, through deviation rolls 2, is supplied to a roller press 3 and therefrom to a cylinder embossing group 4, comprising a cylinder with some in-relief design pattern (pressing cylinder) and a first contrast cylinder for keeping the band pressed against the pressing cylinder in order to emboss the design pattern thereon. In the prior art the cylinders are both made of metal in the typical case of tissue handkerchiefs and napkins, while in case of paper towels and toilet paper the two cylinders are respectively made of rubber and steel. The exiting embossed band is thus fed, through deviation rolls 5, to a folding equipment 6, as shown in FIG. 1, in which the tissue handkerchiefs/napkins are obtained from the band by cutting and folding, or to a rewinder, not shown, for producing toilet paper or paper towel rolls. In the same FIG. 1, below the diagram of the production line as described, there is schematically shown the surface of the band (N1) exiting from the unwinding device 1, of the band (N3) exiting from the roller press 3 and of the band (N4) exiting from the embossing group 4. In the case here exemplified, the embossing, showed using a grey hatching and indicated with 7, is extended over the entire surface, except for a number n of equal and regularly spaced regions (four quadrilateral areas in the illustrated case), indicated with 8. Thus, the resulting paper handkerchief/napkins, once cut from the band, will typically have a central non-embossed area (corresponding to a region 8), and an embossed peripheral frame.

As known to those skilled in the art, embossing in the aforementioned products not only serves a decorative purpose, but also contributes to keep the webs which form these products together. This aspect, i.e. the capacity of the webs to remain joined together during use, is important for determining the quality of the product. The adhesive effect between the webs however depends on the type of paper used, and with less soft and yieldable paper, which may advantageously be used for obtaining less expensive products, this effect reduces remarkably, hence the structure of the end product is unstable. In these cases the use of a bonding agent suitably distributed between the webs in the areas subjected to embossing may help overcome the problem, but the current production lines do not allow a selective distribution of the bonding agent which would end up inevitably deposited even in the non-embossed areas thus stiffening the end product and deteriorating the quality thereof. The need for ensuring high adhesion of the webs also affects the maintenance of the embossing equipment. Actually, ensuring high quality standard as far as the adhesion of the webs is concerned, requires maintaining high pressure between the two metal cylinders, hence leading to quick wear of the same and the need of having to replace them often (usually every six months), thus increasing the production costs. A similar problem arises should one want to selectively print a coloured drawing or motif, a writing or anything else on the non-embossed areas or on the embossed areas of a product. Even in this case the current production lines do not allow for selectively printing the embossed areas or the non-embossed areas, in normal cases the embossed areas of the product completely surrounding the non-embossed areas.

SUMMARY OF THE INVENTION

The general object of the present invention is to provide a plant for the production of embossed articles capable of allowing the distribution of glue or of a design print, decorative patterns, writings or anything else on selected areas of such products.

A particular object of the present invention is to provide a plant of the aforementioned type for the production of paper handkerchiefs or napkins, capable of allowing perfect adhesion of the webs without jeopardizing the softness thereof and regardless of the type of paper used, thus having a positive impact on the production costs.

Another object of the present invention is to provide a plant of the aforementioned type capable of allowing selective printing in areas of the product being processed and capable of increasing the possible combinations of printings with respect to the currently available systems.

Another object of the present invention is to provide a plant of the aforementioned type, in which the wear of the embossing cylinders is lower with respect to what occurs in known plants, thus reducing the stop times for maintenance, and the production costs.

These objects are attained through the plant for the production of embossed articles according to the present invention whose essential characteristics are indicated in claim 1. Further important characteristics are indicated in the dependent claims.

According to an important characteristic of the invention, upstream of the embossing group there is provided a glue dispensing unit and/or a printing unit comprising at least one cliché roll, for the application of the glue on a web of the band, or of the ink on said band, said web or band being moved between the cliché roll and a second contrast cylinder. Actuator means are further provided for driving close or away to each other at least one portion of the cliché roll from the second contrast cylinder as a function of the position of the in-relief design on the surface of the pressing cylinder of the embossing group.

According to particular embodiments of the invention the actuator means may be of the mechanical type, with cam and lever, or of the electronic type, for example with an encoder.

According to another important characteristic of the invention, the cliché roll comprises at least one fixed portion and at least one mobile portion, both linked with driving means that bring the portions into rotation, the at least one mobile portion being linked with the actuator means for approaching/moving away the at least one mobile portion of the cliché roll from the second contrast cylinder.

In a preferred solution of the invention the cliché roll is mounted on a first support adapted to pivotally support the end fixed portions of the same roll, the at least one mobile portion of the cliché roll being interposed between the fixed portions and being integral with a shaft resting on a second support, coaxial with the cliché roll and linked with the actuator means.

In a particular embodiment, the shaft is rotated by first driving means and the fixed portions of the cliché roll are rotated by third driving means that via said shaft are linked to second driving means.

According to another preferred embodiment of the invention the cliché roll comprises at least two mobile portions arranged between the fixed end portions and separated by a corresponding intermediate fixed portion, which is pivotally mounted on a third support coaxial with the shaft and driven thereby through fourth driving means.

In a particular embodiment of the invention the fourth driving means comprise an auxiliary transmission shaft pivotally connected to the first and to the third support and parallel to the shaft of the cliché roll.

BRIEF DESCRIPTION OF THE DRAWINGS

These and other characteristics and advantages of the plant for the production of embossed articles according to the present invention shall be apparent from the following description of an embodiment thereof provided purely by way of non-limiting example with reference to the attached drawings wherein:

FIGS. 3*a* and 3*b* schematically illustrate a possible embodiment of a part of the plant in connection with the interaction between the embossing group and the gluing device in the production line of FIG. 2;

DETAILED DESCRIPTION OF THE INVENTION

Figure 2:
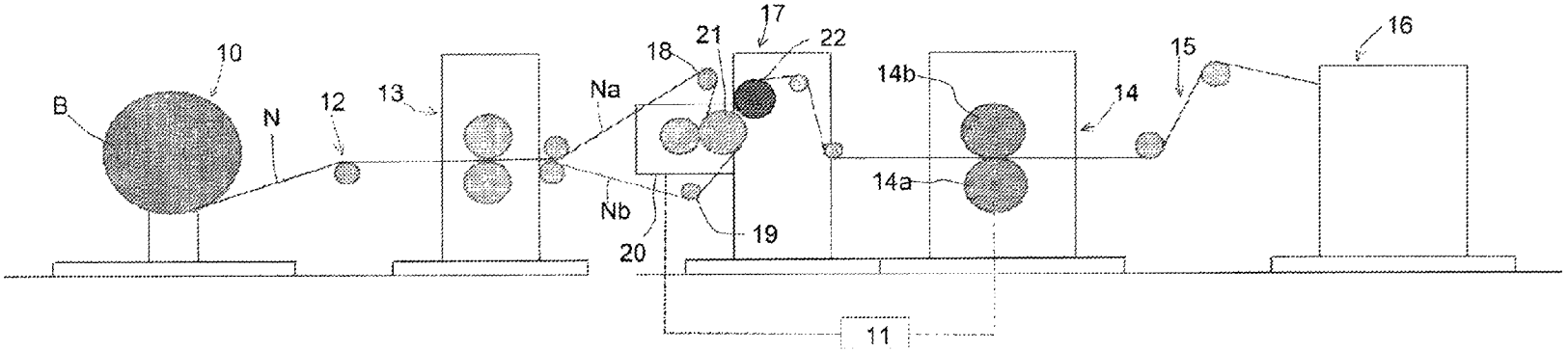
FIG. 2 is a schematic view of a plant for the production of embossed articles including a gluing device according to a first embodiment of the present invention.

With reference to FIG. 2, the plant for the production of embossed articles according to the invention comprises an unwinding device 10, in which there is unrolled a reel of multiweb paper band, for example with three or four webs, indicated with B, and a roller press 13 to which the unrolled band N is fed through deviation rolls 12. The plant further comprises a cylinder embossing group 14, comprising a metal pressing cylinder 14*a*, with in-relief design and a rubber first contrast cylinder 14*b* for keeping the band pressed against the pressing cylinder in order to emboss the design thereon. The band is then fed through deviation rolls 15 to a folding equipment 16. The aforementioned apparatuses are of the conventional type, well known to those skilled in the art and thus shall not be described in further detail.

According to the invention, upstream of the embossing group 14 there is provided a glue dispensing unit generally indicated with 17. The unit 17 comprises a glue application device 20 and two deviation rolls 18 and 19 each of which are fed respectively with one or more webs, generally indicated with Na and Nb that are obtained through internal separation of the band N exiting from the roller press 13 upstream of the glue group 20. The webs Na and Nb are supplied to a second contrast cylinder or roll 21 downstream of the glue group 20. As shown in further detail in FIGS. 3*a* and 3*b*, the glue group 20 comprises, in a manner which is known as such, an anilox roll 20*a* which receives the glue from a tank through a doctor blade and applies it on a cliché roll 20*b*. In normal working conditions, the cliché roll 20*b* brushes the web Na that passes between the same roll and the second contrast cylinder 21, to deposit the glue at a pre-established point. Downstream of the glue application device 20 the web Na carrying the glue is coupled with the web Nb over the opposing roll 21 and the band N thus formed is drawn by a mobile cylinder 22 (the so-called marriage roll) which performs a light compression on the coupled webs to improve the mutual adhesion; the band N is finally sent to the embossing group 14.

Still according to the invention, the position of the cliché roll 20*b* with respect to the contrast cylinder 21 is controlled by the embossing group 14 as a function of the angular position of the pressing cylinder 14*a* through an actuation device, schematically indicated with 11 in FIG. 2, of the mechanical, electromechanical or electronic type. FIGS. 3*a* and 3*b* show a schematic diagram of the actuation device 11, in the specific case, of the mechanical type. The device comprises a cam 23 coaxial with the pressing cylinder 14*a*. A gauge arm 24 rests in contact over the outer profile of the cam and, through a lever linkage 25, is connected to an axial support 26 of the cliché roll 20*b*. The axial support 26 is in the shape of at least one arm which connects the axes of the anilox roll 20*a* and the cliché roll 20*b*, hence the cliché roll 20*b* can be displaced following a circumference the radius of which is substantially equal to the length of the arm 26. Like in the prior art, the arm 26 is extendable telescope-like, e.g. controlled by an actuator, so as to allow for the approaching and moving away of the anilox roll 20*a* towards/from the cliché roll 20*b*.

Figure 1:
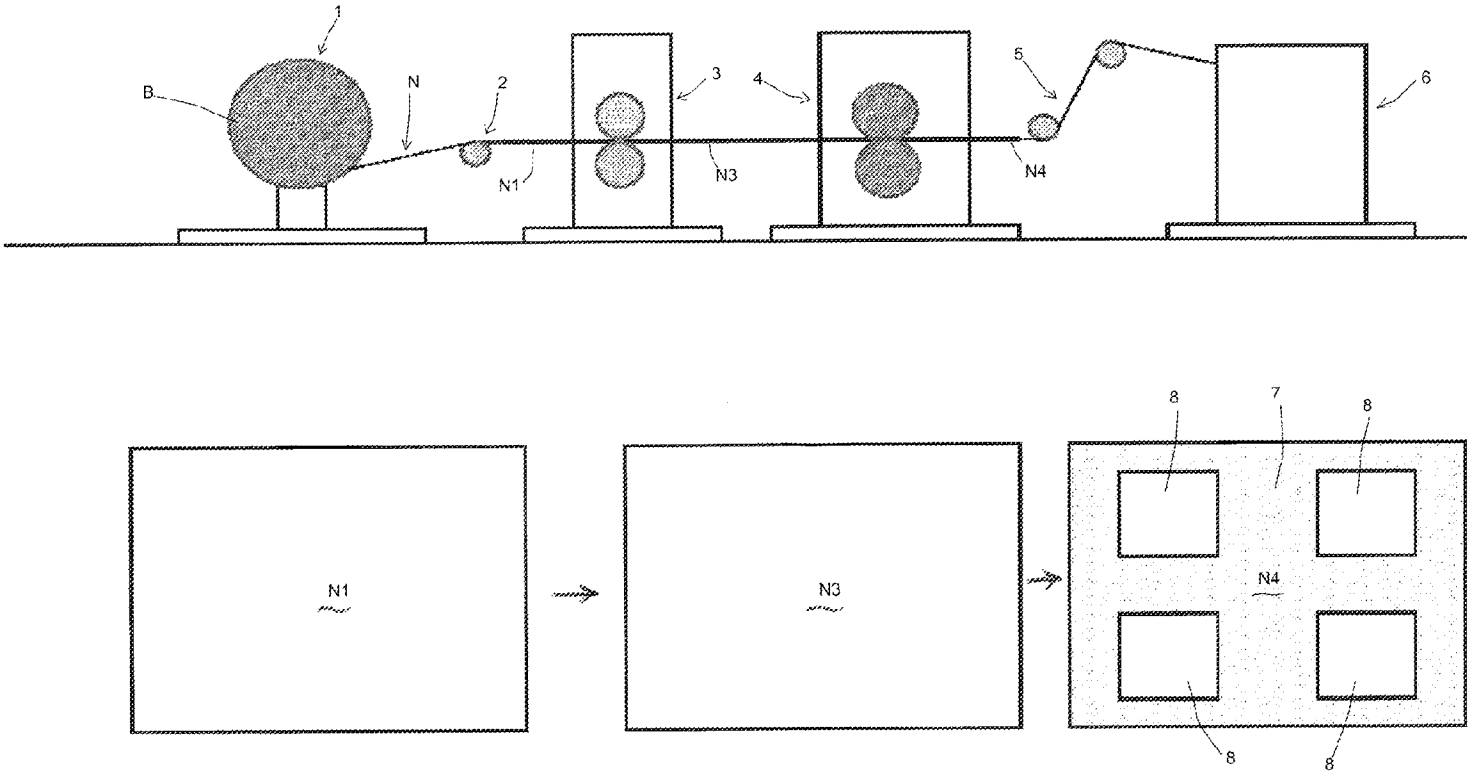
Fig. 1 ( Prior art )
FIG. 1 is a schematic view of a plant for the production of embossed articles according to the prior art, illustrating also the surface configuration of a band exiting from some sections of the plant.

The profile of the cam 23 is designed as a function of the presence/absence of smooth portions on the surface of the cylinder 14*a*, portions intended to obtain non-embossed areas (for example the areas indicated with 8 in FIG. 1) on the product being processed, hence the rotation of the cylinder

14*a* and consequently of the cam 23 produces a cyclic movement of the cliché roll 20*b*, phased with the cylinder 14*a*, from a position of contact with the web Na passing on the contrast cylinder 21, to a position spaced therefrom. In correspondence with these positions there occurs the application or non-application of the glue on the face of the web Na facing towards the cliché roll 20*b*. The contact position and the spaced portion of the cliché roll 20*b* are shown in FIGS. 3*a* and 3*b* respectively and the distance therebetween is in the order of some millimetres, hence a minimum angular movement is enough to prevent contact with the web Na and the deposition of the glue thereon.

Generally speaking, the cam may simply define alternating areas where gluing or printing is to be obtained. Instead of a mechanical cam, it can be an electronic cam defined by a specific mathematical law. For example, the cylinder 14*a* of the embossing group 14 can be associated to an angular position transducer adapted to generate signals as a function of the detected angular position of the same cylinder. The signals are exploited to control a suitable actuator causing the displacement of the cliché roll as described above.

Depending on the distribution of the embossed areas with respect to the non-embossed areas on the finished product, the cliché roll may acquire various configurations, four of which are exemplified in figures from 4 to 9.

Figure 4:
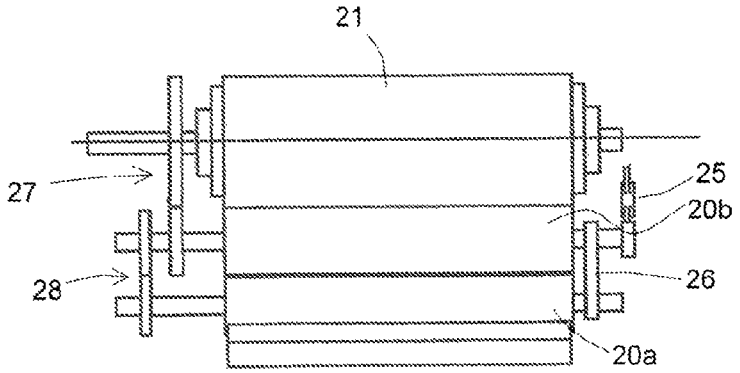
FIG. 4 shows, in plan view, a first embodiment of a cliché roll used in the plant according to the invention.

In FIG. 4 the cliché roll 20*b* has a continuous surface. This configuration, involving the entire width of the paper, may be advantageously used when intending to apply the colour according to axial strips spaced from each other: for example with reference to FIG. 1, when one wants to colour only the portions of the embossed surface 7 which are vertical as seen in the drawing without colouring the embossed ones arranged horizontally between the quadrilateral regions 8.

The drive is transmitted from the axis of the contrast cylinder 21 to the axis of the cliché roll 20*b* through first drive means 27, for example of the gear type, while second drive means 28, for example of the belt type, transmit motion from the axis of the cliché roll 20*b* to the axis of the anilox roll 20*a*. The axes of the anilox roll 20*a* and of the cliché roll are also linked through the extendable support arm 26. At least one of the ends of the axis of the cliché roll 20*b* is linked with the active end of the linkage 25, hence, following the movement of said linkage induced by the rotation of the cam 23 integral with the pressing cylinder 14*a* of the embossing group 14, the cliché roll 20*b* is subjected to a cyclic angular displacement around the axis of the anilox roll 20*a*, to which it is linked via the extendable arm 26.

Figure 5:
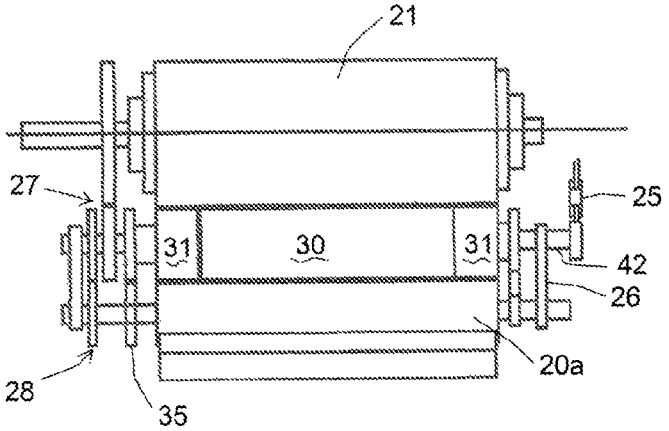
FIGS. 5 and 6 show respectively, in a plan view and in a longitudinal and partly sectional view, a second embodiment of a cliché roll employed in the plant according to the invention.
Figure 6:
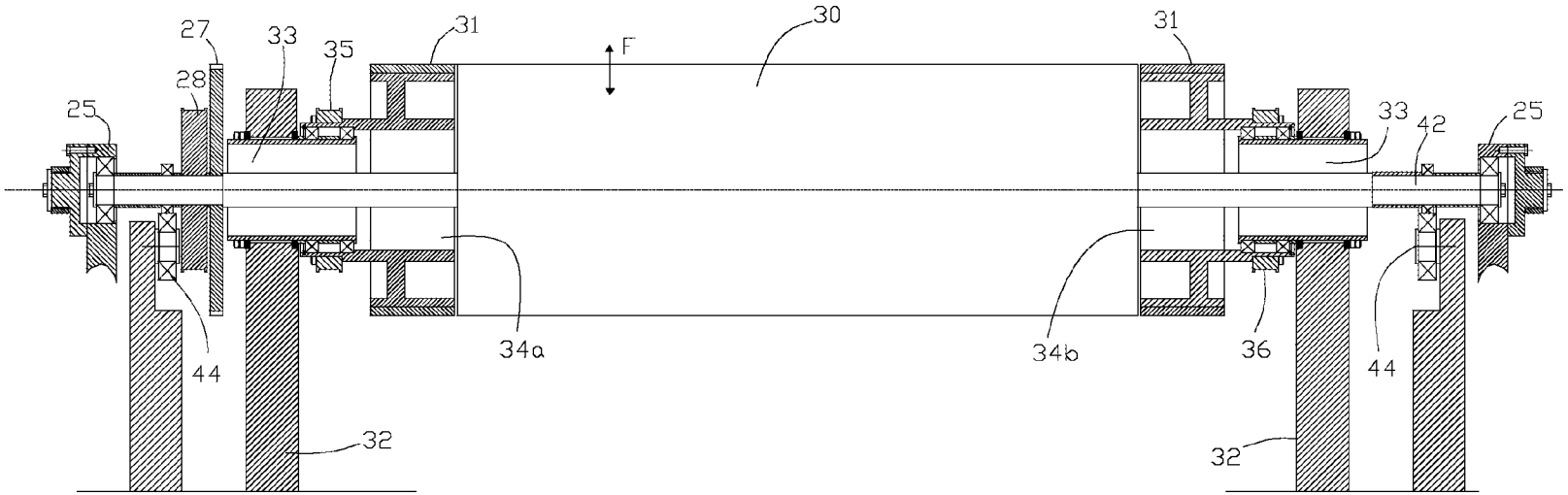

In FIGS. 5 and 6 the cliché roll 20*b* has two fixed end portions 31 and an intermediate portion 30 movable in the direction of arrow F of FIG. 6, as a result of the command coming from the embossing group 14 through the linkage 25. The motion is transmitted from the axis of the contrast cylinder 21 to the axis of the cliché roll 20*b* through first drive means 27, for example of the gear type, while second drive means 28, for example of the belt type, transmit motion from the axis of the cliché roll 20*b* to the axis of the anilox roll 20*a*.

The cliché roll 20*b* is supported by a pair of fixed support uprights 32 carrying, at an end, two coaxial sleeves 33, on which there are pivotally mounted two hollow shafts 34*a* and 34*b* coaxial and opposite to each other carrying the fixed end portions 31 of the cliché roll 20*b*. The two hollow shafts 34*a* and 34*b* are brought into rotation by third drive means 35 and 36 arranged between the axis of the anilox roll 20*a* and the axis of the cliché roll 20*b* at the two ends of the latter. In this way, the fixed end portions 31 of the cliché roll 20*b* are brought into rotation. A shaft 42 brought in rotation by the first drive means 27 is arranged coaxial to the hollow shafts 34*a* and 34*b*. The shaft 42 is integral with the mobile intermediate portion 30 of the cliché roll 20*b* and the ends thereof are connected to the linkage 25. Hence, upon control transmitted by the embossing group 14, the intermediate portion 30 of the cliché roll 20*b* moves in the direction of the arrow F. In the contact position thereof, the cliché roll 20*b* rests on rotatable supports 44 fixed to the structure and serving as an abutment.

Figure 7:
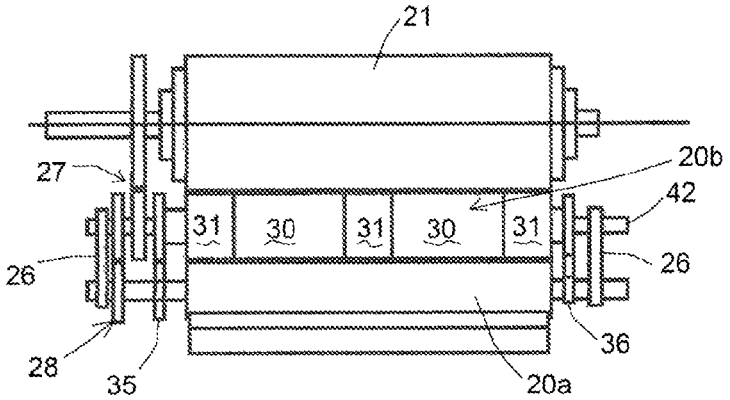
FIGS. 7 and 8 show respectively in a plan view and in a longitudinal and partly sectional view, a third embodiment of a cliché roll used in the plant according to the invention.
Figure 8:
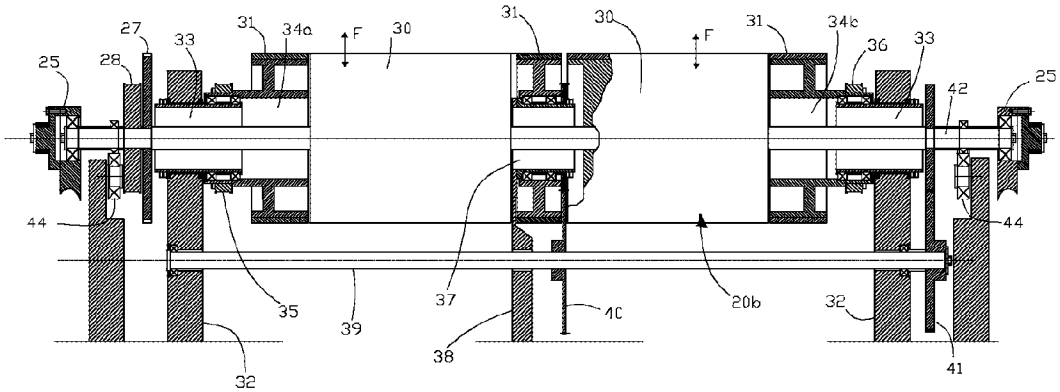

In the embodiment illustrated in FIGS. 7 and 8 the cliché roll 20*b* comprises two internal portions 30 mobile in the direction of the arrow F of FIG. 8 at the command coming from the embossing group 14 through the linkage 25. The two mobile portions 30 are alternating with respect to fixed portions 31, including two end portions and an intermediate one arranged between the two mobile portions.

The cliché roll 20*b* is supported by a pair of fixed support uprights 32 carrying—at one end—two coaxial sleeves 33, on which there are pivotally mounted two coaxial and opposed hollow shafts 34*a* and 34*b* supporting the fixed end portions 31 of the cliché roll 20*b*. The two hollow shafts 34*a* and 34*b* are brought into rotation by third drive means 35 and 36 arranged between the axis of the anilox roll 20*a* and the axis of the cliché roll 20*b* at the two ends of the latter. In this way the fixed end portions 31 of the cliché roll 20*b* are brought in rotation.

The fixed intermediate portion of the cliché roll 20*b* is rotationally driven around a sleeve 37, coaxial to the two hollow shafts 34*a* and 34*b*, rigidly supported by a fixed upright 38. The rotation of said intermediate portion is driven by an auxiliary drive shaft 39, parallel to the cliché roll 20*b* and pivotally supported by uprights 32 and 38, through transmission means 40 arranged between the shaft 39 and the intermediate portion. The rotation of the shaft 39 is driven through fourth drive means 41 controlled by a shaft 42 internal and coaxial to the sleeves 33 and rotated by the first drive means 27 which receive motion from the axis of the contrast cylinder 21. Motion is transmitted to the anilox roll 20*a* through the second drive means 28. The extandable arm which connects the anilox roll 20*a* to the cliché roll 20*b* is indicated with 26.

The internal shaft 42 is linked to the mobile portions 30 of the cliché roll 20*b* to bring them into rotation and move them in the direction of arrow F upon control transmitted by the embossing group 14 through the aforementioned cam and lever mechanism (or an equivalent mechanism); linkage end arms 25 are connected to the shaft 42. In order to allow the aforementioned movement of the shaft 42, the latter is engaged with sufficient clearance in the support 37 and in the contact position thereof it rests on abutment rotatable supports 44 fixed with respect to the structure of the group.

A cliché roll in this configuration allows for spreading the glue on entire crosswise strips of the web, when the mobile portions 30 are coaxial with the fixed portions 31 of the cliché roll, and the application of glue on three longitudinal strips of the web, when the mobile portions 30 are displaced angularly with respect to the fixed portions 31.

Figure 9:
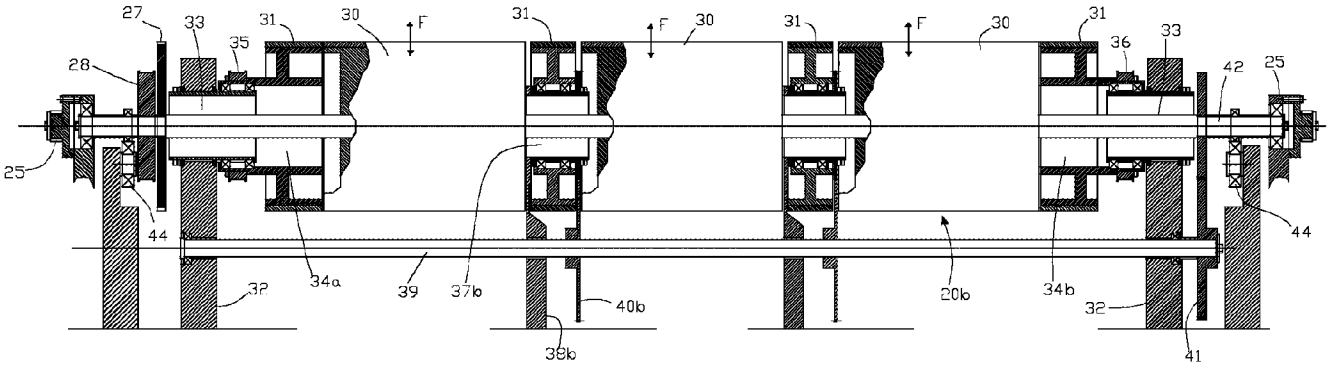
FIG. 9 shows in a longitudinal and partly sectional view, a fourth embodiment of a cliché roll used in the plant according to the invention.

The variant embodiment of the cliché roll 20*b*, illustrated in longitudinal section in FIG. 9, differs from the one illustrated in FIGS. 7 and 8 solely due to the presence of three mobile portions 30 alternatingly separated by four fixed portions 31 two of which are end portions (the other two being intermediate portions). The two fixed intermediate portions 31 of the cliché roll 20*b* are brought into rotation around respective sleeves 37*a* and 37*b*, coaxial to the two hollow shafts 34*a* and 34*b*, rigidly supported by two fixed uprights 38*a* and 38*b*. The rotations of said intermediate portions are commanded by a shaft 39, parallel to the cliché roll 20*b* and pivotally supported by uprights 32, 38*a*, 38*b* through transmission means 40*a* and 40*b* arranged between the shaft 39 and the intermediate portions 31. Like in the embodiment of FIGS. 7 and 8, the rotation of the shaft 39 is activated through fourth drive means 41 controlled by the internal shaft 42 which makes the mobile portions 30 of the cliché roll 20*b* rotate.

Figure 10:
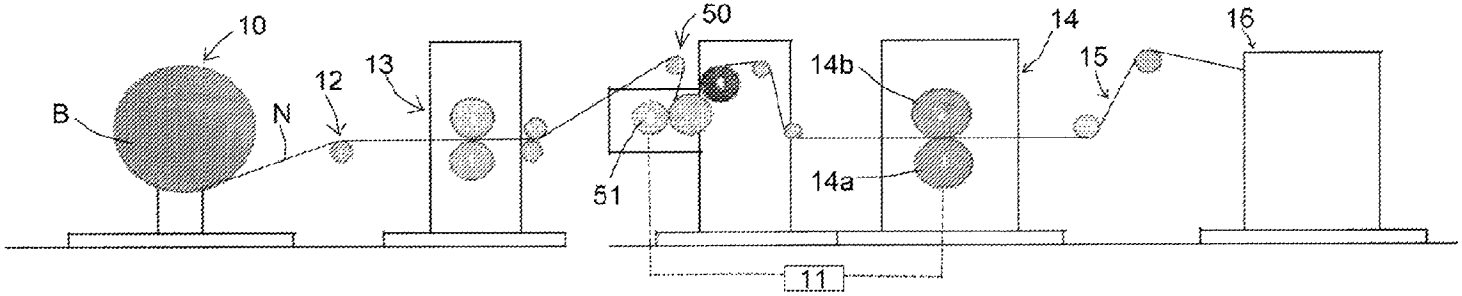
FIGS. 10 and 11 schematically illustrate a plant according to the invention suitable for printing respectively on the lower and upper webs of a paper band.
Figure 11:
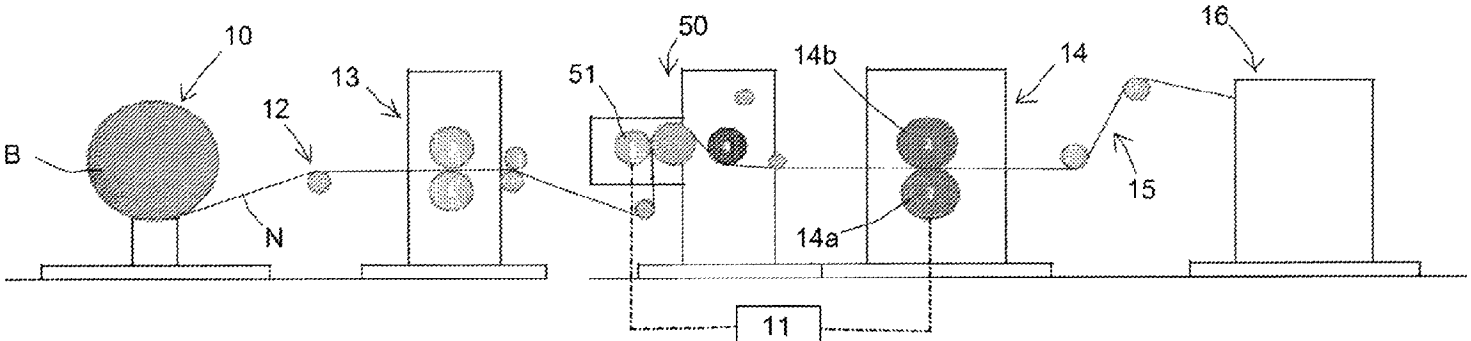

FIGS. 10 and 11 schematically show a plant for the production of embossed articles according to the invention wherein the glue dispensing unit 17 is replaced by a printing unit 50 which allows selectively printing the band on the non-embossed or embossed areas thereof. In particular, in the two configurations of the plant illustrated in FIGS. 10 and 11, there is provided the possibility of printing on one face or the other of the band N. Even in these embodiments of the invention, the position of the cliché roll, indicated with 51, is controlled by the angular position of the roll 14*a* of the embossing group through a control device, still indicated with 11, and the shape of the cliché roll may be the one exemplified in one of FIGS. 4 to 9 or other similar ones.

Figure 12:
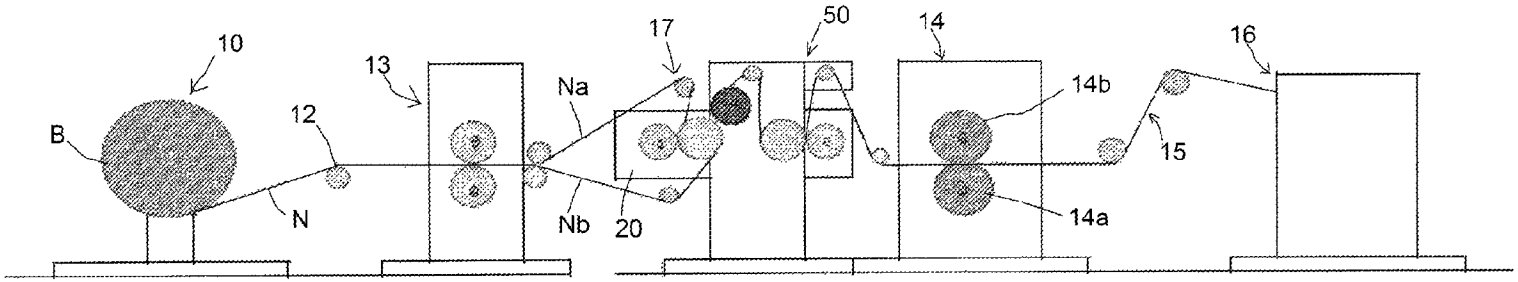
FIGS. 12 and 13 schematically illustrate a plant according to the invention in combined configuration, i.e. suitable for the application of glue and printing respectively on the upper and lower webs of the paper band.
Figure 13:
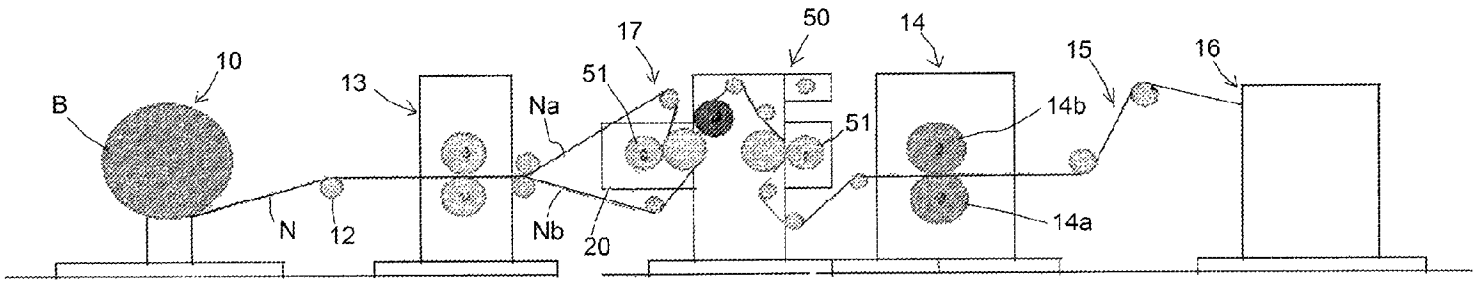

FIGS. 12 and 13 schematically illustrate a combined configuration of the plant for the production of embossed articles according to the invention in which it is possible to both print and deposit glue on selected areas of the band or of the webs it is made of. In the diagram of the plant the unit for applying the glue 17 and the printing unit 50 are arranged in sequence and both are operatively connected to the embossing group 14 through the actuation device 11, suitably doubled to independently control the two units. The band N exiting from the roller press 13 is de-coupled into two webs or groups of webs, Na and Nb, so as to be able to apply the glue on one of them in the glue dispensing units 17, and thus coupled again so as to be fed to the printing unit 50. The configurations of the plant of FIGS. 12 and 13 provide for the possibility of printing on one or the other face of the band N.

The glue dispensing unit 17 and the printing unit 50 are of the conventional type and thus they may be of the doctor blade type, as provided for above, or of any other type, for example with nozzles.

In particular, also the anilox roll 20*b* may be obtained as several coaxial portions thus allowing, in case of printing, using black ink or ink of any other colour, given that the single blade groups, containing ink, can be supplied with various kinds of ink coming from different pumps. This variant embodiment of the invention is not illustrated in further detail, being it is easily understandable to the skilled person from what has been described above.

Figure 14A:
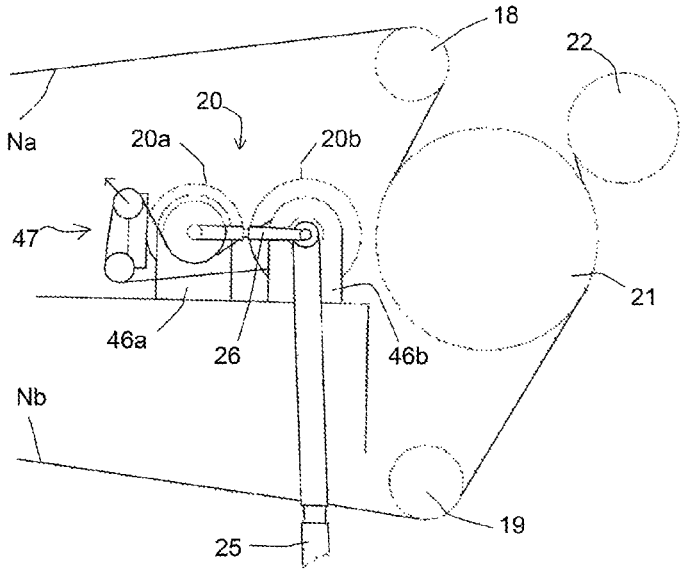
FIGS. 14*a* and 14*b* schematically illustrate, in two working positions, the glue dispensing device of the plant according to the invention.
Figure 14B:
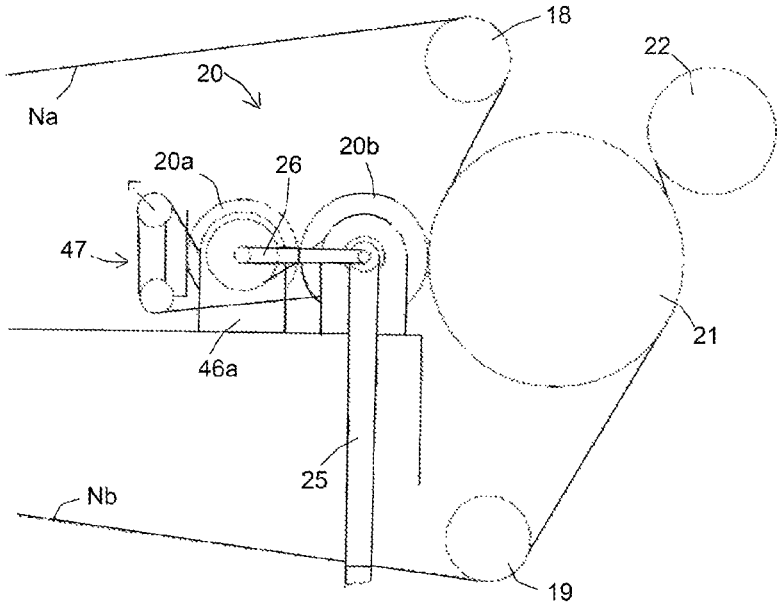

FIGS. 14*a* and 14*b* respectively show, in lateral view, the glue group 20 in a stop condition, in which the anilox roll 20*a* is spaced from the cliché roll 20*b* and the latter is spaced from the second contrast cylinder 21, and in the working condition in which the anilox roll 20*a* is in contact with the cliché roll 20*b* and the latter is in turn in contact with the contrast cylinder 21. The anilox roll 20*a* and the cliché roll 20*b* are mounted on respective mobile support arms 46*a* and 46*b* which allow for the mutual approaching and the moving away movements with respect to the contrast cylinder 21. A pulling belt device, generally indicated with 47 is then provided for maintaining the roll with the cliché phased with the anilox roll when, upon control of said actuator means, the cliché roll is moved away from the contrast cylinder.

Figure 15:
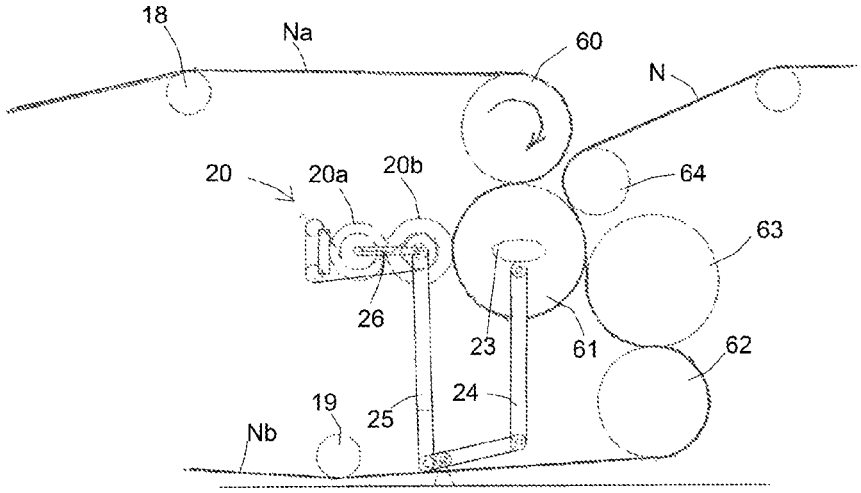
FIG. 15 shows, in a schematic lateral view, a further embodiment of the invention.

In an even further embodiment of the invention, schematically shown in FIG. 15, the second contrast cylinder consists in the pressing cylinder of the embossing group on which there are provided decorative patterns to be embossed on the article. With reference to FIG. 15, the band N is separated into the webs Na and Nb. The web Na is guided between a rubber-covered cylinder 60 and the embossing cylinder 61 in contact with the cliché roll 20*b*. The web Nb is guided between a rubber-covered cylinder 62 and a steel cylinder 63 and then it is coupled again with the web coming from the cylinders 60 and 61 on a marriage roll 64. In this case the embossing is performed separately on the two webs, when also glue is applied on one of them. The advantage of this solution lies in the fact that the anilox cliché group can replace the corresponding current system in use for hygienic products and paper towels, thus leading to a new type of 'non-continuous embossing' currently not available in the market, both for gluing and printing. In addition, should the embossing have big sized patterns, the print on the paper can obtained only by pressing using a rubber-covered roll. Therefore, the configuration of FIG. 15 is in this case the most preferred.

Figure 16:
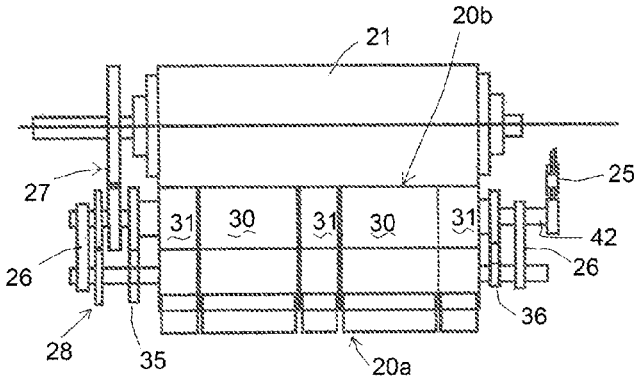
FIG. 16 shows, in a schematic plan view, an even further embodiment of the invention.

Even the anilox roll 20*a* may be obtained in several units or independent sectors. This variant, schematically shown in FIG. 16 and known to a man skilled in the art, may be particularly useful for managing different colours or coloured glue, in order to have products of different colour produced in the same plant. Instead of an anilox roll there are provided various rolls placed side by side to each other integral with the same shaft, with the relative blade groups which can receive various colours. Independent pumps serving the same purpose as the pump of the single anilox roll guarantees that the colour is maintained on the blade. The pump maintains the level of colour in the blade constant by making use of a level probe. The colour replenished in the blade group (this is a casing arranged beside the roll, sealed thereon by means of metal or plastic scrapers in the axial direction of the roll, and gaskets in the transverse direction) comes from a tank. The replenished colour is the one that is consumed in the printing process.

A plant intended to produce articles such as paper napkins or handkerchiefs and the like tissue articles has been described above. Should the plant be used for producing toilet paper or paper towel and the like, the folding unit 16 is replaced by a rewinder for forming rolls.

Although the present description has made reference to embossed articles of the paper or tissue converting industry, it is clear that the plant according to the invention can be used, when suitably adapted, even for articles that require embossing in the textile industry or in other fields.

The plant for the production of embossed articles according to the present invention can be subjected to variants and or modifications without departing from the scope of protection of the invention as defined in the following claims.

The invention claimed is:

1. A plant for the production of embossed articles comprising a cylinder embossing group, formed by a metal pressing cylinder, with in-relief design, and a first contrast cylinder to keep a multiweb paper band pressed against the pressing cylinder in order to emboss said design thereon, wherein a glue dispensing unit and/or a printing unit is provided upstream of said embossing unit and comprises at least one cliché roll for applying glue on a web of said band or ink on said band, said web or said band moving forward between said cliché roll and a second contrast cylinder, actuator means being further provided for contacting or moving away at least one portion of said cliché roll from said second contrast cylinder as a function of the position of said raised design on the surface of said pressing cylinder.

2. The plant according to claim 1, wherein said actuator means comprise lever linkage means acting on said cliché roll adapted to cause the displacement of at least one portion thereof from a contacting position to a moved away position, and vice versa, from said second contrast cylinder and controlled by detection means of the angular position of said pressing cylinder of the embossing group.

3. The plant according to claim 2, wherein said detection means comprise a cam group, the cam being coaxially integral with said pressing cylinder of the embossing group.

4. The plant according to claim 2, wherein said actuator means comprise encoder means associated to said pressing cylinder.

5. The plant according to claim 1, wherein at least one portion of said cliché roll is adapted to displace along an arc of circumference.

6. The plant according to claim 1, wherein said cliché roll comprises at least one fixed portion and at least one mobile portion both linked with means adapted to bring said portions into rotation, said at least one mobile portion being linked with said actuator means to put in contact/move away said at least one mobile portion of said cliché roll to/from said second contrast cylinder.

7. The plant according to claim 6, wherein said cliché roll is mounted on a first support for pivotally supporting the end fixed portions of said cliché roll, said at least one mobile portion of said cliché roll being arranged between said fixed portions and being integral to a shaft held by a second support, coaxial with said cliché roll and linked with said actuator means.

8. The plant according to claim 7, comprising first driving means adapted to rotate said shaft and third driving means adapted to rotate said fixed portions of said cliché roll, said third driving means linked via said shaft to second driving means.

9. The plant according to claim 7, wherein said cliché roll comprises at least two mobile portions arranged between said end fixed portions and separated by a corresponding intermediate fixed portion, said intermediate fixed portion being pivotally mounted on a third support coaxial to said shaft, fourth driving means being further provided adapted for transmitting rotation from said shaft to said intermediate fixed portion.

10. The plant according to claim 9, wherein said fourth driving means comprise an auxiliary transmission shaft pivotally connected to said first and third support and parallel to said shaft of said cliché roll.

11. The plant according to claim 1, wherein said second contrast cylinder of said glue dispensing unit consists in the pressing cylinder of an embossing group further comprising a first rubber-covered cylinder cooperating with said pressing cylinder for embossing a web of said band, the embossing group further comprising and a second rubber-covered cylinder cooperating with a third cylinder for embossing the other web of said band, coupling means for coupling the embossed webs.

12. The plant according to claim 1, further comprising, upstream of the glue dispensing unit and/or the printing unit an unwinding device, in which a multiweb paper reel is unrolled, and a roller press and, downstream of the embossing group, a folding equipment or a rewinder unit.

13. The plant according to claim 1, wherein the cliché roll is linked with an anilox roll through an axial support in the form of at least one arm connecting respective axes of the anilox roll and the cliché roll, said arm having a substantially telescopic structure to put into contact/move away the cliché roll to/from the anilox roll, pulling belt means being further provided to keep the cliché roll in phase with the anilox roll when, under the control of said actuator means the cliché roll is moved away from said second contrast cylinder.

14. The plant according to claim 1, wherein the anilox roll comprises independent units formed by rolls arranged close to each other integral to the same shaft, with doctor blade groups adapted to contain different colours.

* * * * *